US005802833A

United States Patent [19]

Boni

[11] Patent Number: 5,802,833

[45] Date of Patent: Sep. 8, 1998

[54] TEXTILE MACHINE FOR FORMING YARN WINDINGS OF ANY SHAPE

[75] Inventor: Romano Boni, Via Umberto I°, 10-Gottolengo (Brescia), Italy

[73] Assignees: Romano Boni; Mariella Cotti, both of Italy

[21] Appl. No.: 627,645

[22] Filed: Apr. 4, 1996

[30] Foreign Application Priority Data

May 22, 1995 [IT] Italy ..... MI95A1038

[51] Int. Cl.[6] ..... D01H 7/46

[52] U.S. Cl. ..... 57/264; 242/413.2; 242/419.1

[58] Field of Search ..... 57/264; 242/413.2, 242/419.1, 419.9

[56] References Cited

U.S. PATENT DOCUMENTS

| | | | |
|---|---|---|---|
| 4,134,253 | 1/1979 | Handa et al. | 57/264 |
| 4,445,322 | 5/1984 | Satterfield | 57/264 |
| 4,467,593 | 8/1984 | Araki | 57/264 |
| 4,531,353 | 7/1985 | Majette | 57/264 |
| 4,551,969 | 11/1985 | Kogiso et al. | 57/264 |
| 4,628,675 | 12/1986 | Sakamoto | 57/264 |
| 4,697,408 | 10/1987 | Kohata et al. | 57/264 |
| 5,084,823 | 1/1992 | Andrews, III et al. | 364/470 |
| 5,113,708 | 5/1992 | Bode et al. | 57/264 |
| 5,469,149 | 11/1995 | Binner et al. | 57/264 |

FOREIGN PATENT DOCUMENTS

| | | | |
|---|---|---|---|
| 0403927 | 12/1990 | European Pat. Off. . | |
| 0610144 | 8/1994 | European Pat. Off. . | |
| 3090634 | 4/1991 | Japan | 57/264 |
| 380607 | 9/1964 | Switzerland . | |

*Primary Examiner*—William Stryjewski
*Attorney, Agent, or Firm*—Hedman, Gibson & Costigan, P.C.

[57] ABSTRACT

A textile machine for forming yarn windings of any shape comprising a frame, a feed of yarn to be treated, a support element, provided with a motor for its rotation, for collecting and winding treated yarn, a thread guide for distributing the yarn along the support element, at least one roller, provided with a motor for its rotation, which receives yarn from the yarn feed and feeds it to the collecting support element via the thread guide, and a sensor positioned between the at least one roller and the support element for collecting the treated yarn, in which machine the sensor senses the braking force generated by the at least one roller on the yarn being wound on the support element, and is connected to a processor which compares the measured braking force with a preset force, and varies the rotational speed of the motor of the at least one roller to adjust the previously measured braking force to the preset value by increasing the rotational speed of the roller if the measured braking force is greater than the preset value, and decreasing the rotational speed of the roller if the measured braking force is less than the preset value.

5 Claims, 1 Drawing Sheet

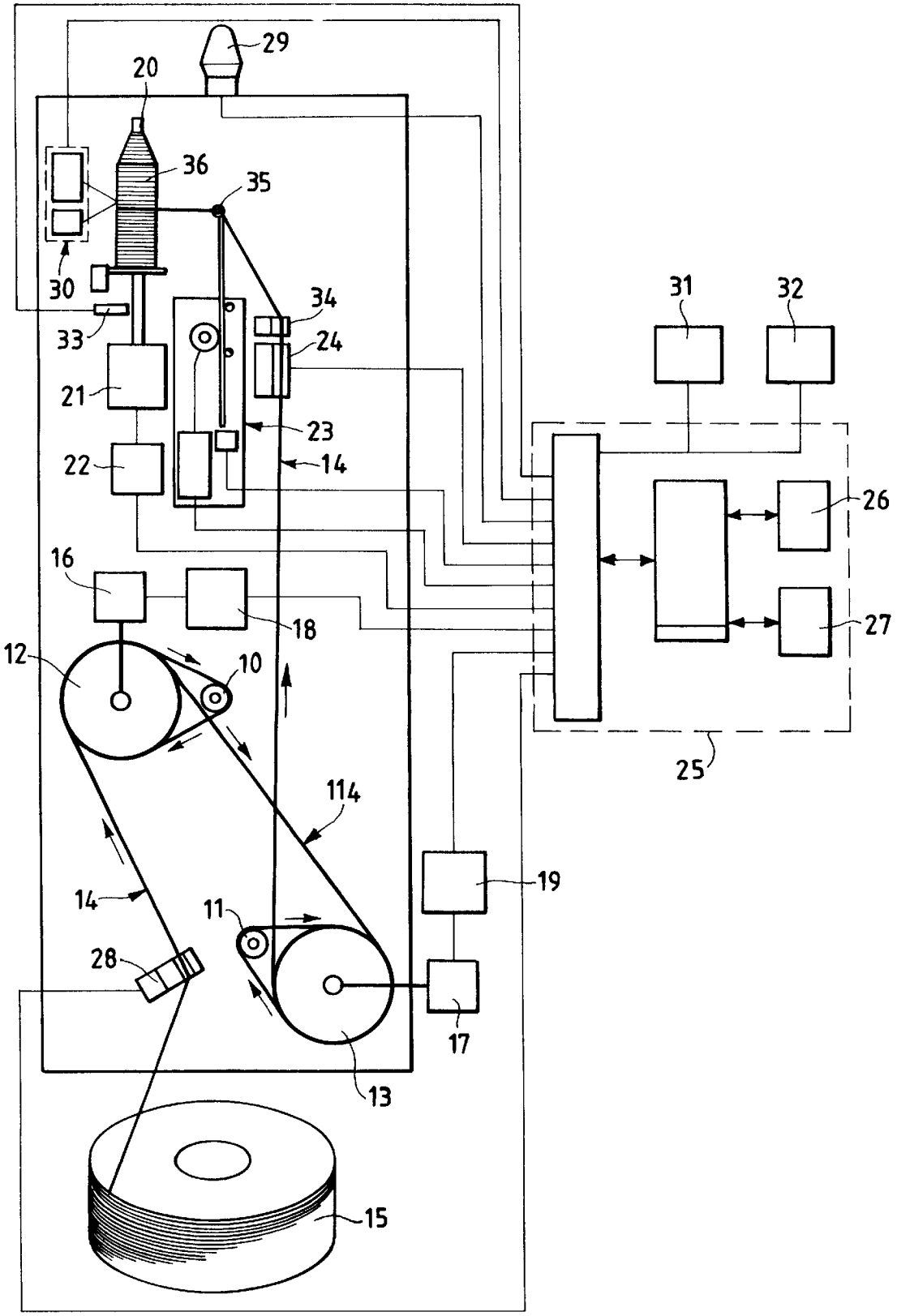
29
20
36
35
30
33
34
24
21
23
22
14
31
32
26
27
16
18
12
10
25
114
19
14
11
28
17
13
15

TEXTILE MACHINE FOR FORMING YARN WINDINGS OF ANY SHAPE

This invention relates to a machine for forming yarn windings of any shape.

In addition to the processing necessary for their production, synthetic yarns for textile use are subjected by the final user to further treatments which have long formed part of the textile art. The same type of yarn can for example be subjected by specific machines to elongation by hot or cold drawing, twisting, false twisting and texturing by mechanisms of various kinds, or combining of several yarns by passing through compressed air or mechanical equipment which mixes the individual fibres together. In addition to these standard treatments there are a multitude of specific exclusive processes which every yarn user implements to obtain those characteristic qualities of the final product which distinguish it from the products of the competition.

Each textile machine implementing any given treatment uses yarn which has been prepared by machines preceding it in the production cycle, and must therefore unwind it in order to use it, after which use the yarn has to be rewound on a support such that it can either be stored or be used by subsequent machines in the production cycle.

All the aforesaid yarn treatments produce a degree of yarn lengthening or shortening, which has to be maintained within perfectly controlled and calculated values. This yarn length variation is normally obtained and controlled by dragging the yarn by rollers which rotate at different peripheral speeds, hence achieving an extent of lengthening or shortening proportional to the difference between the relative peripheral speeds of the rollers.

After undergoing the scheduled treatment, on leaving the last roller the yarn is rewound on a support via an oscillating thread guide so that it can either be stored or be used by subsequent machines in the production cycle.

The two types of support currently used are bobbins provided with flanges for laterally containing the yarn turns, and tubes on which the turns are arranged such as to achieve a progressive reduction in the winding length and obtain a stable winding without the need for side flanges. In both cases it is absolutely essential to carefully synchronize the speeds of the rollers and the support on which the yarn is wound, because otherwise the yarn could break due to excess tension or could undergo tangling due to tension deficiency.

Synchronization cannot be based on a fixed ratio because the yarn winds on a continually increasing diameter which, if a constant angular velocity is maintained, would result in a linear speed increase of the yarn such as to cause it to break. To achieve this synchronization, mechanical methods have been used for a considerable time, but are now being replaced by electronic systems.

Mechanical systems use a roller synchronized at a fixed ratio with the rest of the machine and resting on the outer surface of the bobbin. In this manner the bobbin rotates at a variable angular velocity based on its diameter, but its outer surface on which the yarn winds remains synchronized with the other machine members. A further function of the roller resting on the bobbin surface is to transmit to the machine members information regarding the dimension attained by the winding, so that the travel of the thread guide which governs the winding geometry can be varied. However, although the concept of a roller resting on the bobbin surface has been used for many years, the higher speeds now required of textile machines and the continuous search for yarns composed of an increasingly larger number of individual strands have given rise to serious drawbacks.

The worst of these is that as it is not possible to increase the roller pressure against the bobbin surface beyond a certain limit without deteriorating the yarn characteristics, the roller tends to separate from the surface because of inevitable small eccentricities, with consequent loss of synchronism. This results in a continuous uncontrolled elongation and shortening of that yarn portion lying between the collection bobbin and the preceding machine part.

These continuous length variations are absorbed only to a minimum degree by the yarn elasticity, and result in serious winding irregularities. In such cases the winding turns are either too taut or too slack, and the continuous impact of the roller against the surface causes the turns to shift and undergo denting, hence prejudicing subsequent yarn unwinding.

These serious drawbacks have been partly eliminated by certain machines utilizing electronic control. In this respect, electronic component manufacturers have recently made available certain types of force measurement devices which when positioned along the path of the yarn generate an electrical voltage proportional to the force applied to the yarn.

This electrical voltage is then used to regulate the rotational speed of the support on which the winding is formed, such as to maintain the tension exerted on the yarn constant.

The method so far used is to control the speed of the motor which rotates the support on which the yarn is wound.

Although this method is more precise and reliable than the others described heretofore, it has certain drawbacks which limit its use.

In this respect, to attain the high working rate required of current machines, high-frequency motors of low power, low torque and very high rpm are used to drive the support on which the bobbin is formed. These motor characteristics are in contrast to the characteristics of the yarn windings, which starting from a very small initial weight can attain a weight of three or four times the weight of the rotating parts of the motor when the winding is complete.

The system is hence one of low power and very high inertia with consequent control difficulties, in contrast with control theory which specifies a constant inertial force. This can be overcome only by considerably complicating the electronic control part and by increasing the motor power, with a consequent increase in electricity consumption.

An object of the present invention is to provide a machine for forming yarn windings of any shape, which is also able to perform operations involving yarn elongation or shortening, and is completely controlled by electronic means.

A further object of the invention is to achieve maximum winding regularity without having to correct the speed of the support element on which the yarn is wound after processing.

The aforesaid objects are attained according to the present invention by a machine as defined in the accompanying claims. According to the invention the yarn winding and treatment machine therefore automatically adapts to the braking force and provides electronic control of the thread guide operating parameters. The characteristics and advantages of a machine according to the invention will be more apparent from the description thereof given hereinafter with reference to the accompanying drawing, which schematically shows one embodiment of the machine structure and the elements connected to it.

A machine for forming yarn windings of any shape according to the present invention essentially comprises a general support frame on which one or more rollers, namely two rollers 12 and 13 in the illustrated embodiment, are located for driving the yarn 14 fed from a large skein or similar deposit 15. Separator rollers 10 and 11 associated with the rollers 12 and 13 are provided to ensure that the yarn does not undergo straddling on the rollers 12 and 13. The rollers 12 and 13 are rotated by respective motors 16 and 17, they can be connected together electrically or mechanically, and are rotated by one or more electric motors with mutually controlled rotational speed, as the motors 16, 17 are driven by one or more drivers such as electronic frequency changers 18, 19 or are connected together mechanically by a belt and pulley arrangement, not shown.

A support element 20, on which the yarn 14 is wound, is rotated by an electric motor 21 controlled by a relative driver, such as an electronic frequency changer 22.

A thread guide, indicated overall by 23, such as that of granted European patent 403,927, consisting of a stepping motor with relative driver and a wheel of elastic material engaging a rod driven with alternating movement between two electronically variable positions, distributes the yarn along the support element 20.

A sensor 24 is provided downstream of the rollers 12 and 13 and prior to said support element 20, to measure the braking force exerted on the yarn 14. It should be noted that all the aforestated units are connected to a processor 25 which controls the various movements in accordance with programmed logic. Specifically, the said sensor 24 measures a force which it converts into an electrical voltage which is analyzed in the processor 25 and compared with a preset comparison force. If the values differ, the processor 25 changes the rotational speed of the motor 17 and/or 16 via the respective driver 19 and/or 18, and then acts on the respective roller 13 and/or 12 to adjust the previously measured braking force to the preset value. In practice, it increases the rotational speed of the roller when the measured braking force exceeds the preset force and decreases the rotational speed of the roller when the measured braking force is less than the preset or programmed force. This is achieved by the presence of electronic memories 26 and 27 in the processor 25. The machine also comprises a yarn cutting device 28, an indicator or indicating lamp 29 and a unit, indicated overall by 30, for measuring the diameter of the winding on the support element 20. Alphanumerical indicators 31 and switches 32 are provided acting as the interface between the operator and the control members of the machine of the invention.

The presence of a diameter measurement unit, such as for example that shown at 30, enables the motor 21 rotating the support element 20 to be controlled in such a manner as to maintain the correct rotation for winding the yarn as the diameter of the winding under formation varies. For this purpose a further sensor 33 can be provided to measure the rotational speed of the motor 21 and hence of the support element 20.

In particular, the unit 30 which measures the diameter of the winding under formation enables the travel reversal points of the thread guide 23 to be varied to adapt them to the bobbin shape memorized in the processor program, on the basis of the measured diameter, so enabling the winding shape to be automatically resumed even after process interruptions.

The illustrated example shows a measurement unit 30 using a system of infrared rays acting on the winding under formation.

Equivalently, dispensing with the sensor, it will be apparent that the peripheral speed of the roller 12 or 13 expressed in metres per minute divided by the speed of the shaft driving the support element 20 expressed in rpm gives the winding circumference in metres, which dividing by 3.14 gives the winding diameter achieved. This merely requires knowledge of the roller diameter and speed.

A further characteristic of the machine of the invention is that the sensor 24 can also operate as a yarn presence sensor, if the measured braking force is zero. If required, a specific yarn surveillance element 34 can be provided to monitor yarn presence or absence.

It can be seen from the figure that the yarn 14 fed from the deposit 15 passes through the yarn cutter 28 and is driven by the roller 12 rotated by the motor 16 with the aid of the separator roller 10. The yarn 14 takes a free rectilinear path 114 along which the user can install equipment for a specific treatment, and is then dragged by the roller 13 rotated by the motor 17. As stated, alternatively a belt can be used connecting the two rollers 12 and 13 via pulleys (not shown). The separator rollers 10 and 11 ensure that the yarn does not undergo straddling on the respective rollers.

The yarn 14 then traverses the sensor 24 which measures the braking force which the treatment unit exerts on the yarn, and then traverses the possible yarn surveillance unit 34 to engage in a ceramic element 35 of the said thread guide unit 23. The winding is made on the support element 20, which is rotated by the motor 21. The winding diameter is measured for example by the infrared measurement unit 30. The sensor 33 measures the rotational speed of the motor 21.

The indicator lamp 29 warns the operator that the machine has stopped or that the braking force or yarn speed is outside the set parameter range.

The alphanumerical indicator 31 and the pushbuttons and switches 32 form the interface between the operator and the machine control members.

The relationship between and the function of the aforesaid devices will be apparent from the ensuing description.

The relationship between the operating and control members of the treatment and winding machine is shown in the form of blocks. In the ensuing description, each command fed to the machine by the operator and each action of the machine electrical members are to be considered as controlled by the processor 25 and are consequently governed by the program memorized in the electronic memories 26 and 27.

There will therefore be no repetition each time of the following sequence: command by the operator or signal from the sensors, processing and control of the parameters set by the microprocessor and consequent electrical operation of the devices provided for the various functions.

The machine is started by pressing the appropriate button on the keyboard 32.

This causes progressive start of the motor 21 controlled by the driver 22 at a speed based on the winding diameter measured by the sensor 30.

The yarn portion between the roller 13 and the winding 36 starts to become taut and the sensor 24 senses a progressive increase in the braking force applied to the yarn 14.

When said force reaches the set limit the drivers 18 and 19 also start to operate, to rotate the rollers 12 and 13 via the motors 16 and 17.

As a result of the rotation of the rollers 12 and 13 the yarn 14 travels and the braking force decreases to the point at which the sensor 24 measures a braking force less than the programmed force, to determine a slowing-down of the rollers 12 and 13 tending to return the braking force to within the set limits.

The rotational speed of the winding 36 measured by the sensor 33 is used by the device 23 to proportionally operate the actual thread guide 35.

The yarn 14 is guided so that it becomes arranged in an ordered manner in accordance with the arrangement set by the program for the diameter reached by the winding 36 at that precise moment. The winding proceeds in accordance with the program, with the motor 21 varying its speed on the basis of the diameter read by the sensor 30 or the like, and the sensor 24 controlling the rollers 12 and 13 such as to maintain the braking force exerted on the yarn constant at the set value.

This situation remains until one of the following situations occurs:

The diameter sensor 30 senses the attainment of the programmed winding diameter, the motor 21 then progressively slowing down. Consequently the sensor 24 slows down the rollers 12 and 13 until the sensor 33 senses that the motor 21 is at rest, on which it disenables the motor drivers and lights the lamp 29 to call the attention of the operator.

The sensor 34 senses that the yarn is not travelling even though the motor 21 is moving, or the sensor 24 senses that the braking force is below the set parameters. This indicates a breakage of the yarn 14, and hence the yarn cutter 28 is operated to prevent the yarn winding about one of the rollers 12 and 13. The motor drivers are then disenabled and the lamp 29 is lit. The materials used and the dimensions, and the form and nature of the sensors and the control and operating means are susceptible to numerous modifications according to requirements, as falling within the scope of the expert of the art and within the principles of the inventive concept defined in the accompanying claims.

I claim:

1. A textile machine for forming yarn windings of any shape comprising:

a frame;

a feed of yarn to be treated;

a support element, provided with a motor for its rotation, for collecting and winding treated yarn;

a thread guide for distributing the yarn along the support element;

a pair of rollers, each provided with a driver controlled motor for its rotation, which receives yarn from the yarn feed and feeds it to the collecting element via the thread guide;

a sensor element being positioned between said pair of rollers and the support element for collecting the treated yarn;

characterised in that said sensor element measures the braking force exerted on the yarn generated by said pair of rollers by measuring said force and converting it to an electrical voltage, said sensor being connected to a processor which compares said electrical voltage with a preset value, and independently electronically varies the rotational speed of the respective motors of each roller to adjust the previously measured braking force to the preset value by increasing the speed of the roller if the measured braking force exceeds the preset value and decreasing the rotational speed of each roller if the measured braking force is less than the preset value.

2. A machine as claimed in claim 1, characterised by comprising a unit which measures the diameter of the winding on said support element and is connected to memories in said processor and to said thread guide so as to enable the shape of the winding being formed to be resumed after each interruption.

3. A machine as claimed in claim 2, characterised in that said unit for measuring the winding diameter consists of an infrared sensor positioned to the side of the surface of said winding being formed.

4. A machine as claimed in claim 1, wherein said pair of rollers which are provided with separator rollers are associated to prevent the yarn undergoing straddling on said rollers.

5. A machine as claimed in claim 1, characterised in that said rollers comprise a pair of rollers, one of which is provided with a motor, whereas the other is mechanically connected to the first, each of said rollers having associated separator rollers to prevent the yarn from undergoing straddling on said pair of rollers.

* * * * *